United States Patent [19]

Arneson

[11] Patent Number: 4,460,462

[45] Date of Patent: Jul. 17, 1984

[54] LEAF TRAP AND MAIN DRAIN ASSEMBLY

[75] Inventor: Howard M. Arneson, San Rafael, Calif.

[73] Assignee: Arneson Products, Inc., Corte Madera, Calif.

[21] Appl. No.: 375,729

[22] Filed: May 7, 1982

[51] Int. Cl.[3] ..... B01D 23/00; E04H 3/20

[52] U.S. Cl. ..... 210/163; 210/169; 210/237; 210/474; 210/477

[58] Field of Search ..... 210/164, 166, 169, 237, 210/238, 460, 461, 456, 477, 479, 163, 474, 163, 165

[56] References Cited

U.S. PATENT DOCUMENTS

| | | | |
|---|---|---|---|
| 149,373 | 4/1874 | Clapp | 210/163 |
| 530,816 | 12/1894 | Wright | 210/164 |
| 645,749 | 3/1900 | Kasschau | 210/163 |
| 1,865,209 | 8/1931 | Pretsch | 210/461 |
| 1,959,623 | 5/1934 | Gordon | 210/477 |
| 2,182,795 | 12/1939 | Day | 210/164 |
| 2,550,401 | 4/1951 | Boosey | 210/238 |
| 3,173,865 | 3/1965 | Bosico | 210/169 |
| 3,239,149 | 3/1966 | Lindberg, Jr. | 210/169 |
| 3,469,700 | 9/1969 | Johnson | 210/169 |
| 3,512,647 | 5/1970 | Young | 210/169 |
| 3,667,611 | 6/1972 | Pansini | 210/169 |
| 3,680,706 | 8/1972 | Baer et al. | 210/238 |
| 3,713,539 | 1/1973 | Thompson et al. | 210/164 |
| 3,839,749 | 10/1974 | Blumenfeld et al. | 210/166 |
| 3,856,679 | 12/1974 | Jackson | 210/169 |

*Primary Examiner*—Benoit Castel
*Assistant Examiner*—John W. Czaja
*Attorney, Agent, or Firm*—Fulwider, Patton, Rieber, Lee & Utecht

[57] ABSTRACT

A swimming pool leaf trap and main drain assembly collects and removes leaves and other debris from the floor of a swimming pool. The assembly includes a main drain recessed in a swimming pool floor and formed with a drain opening connected to a return line. The main drain removably houses an apertured basket that receives leaves, the normal downward flow of swimming pool water through the main drain trapping the leaves within the basket. The cover of the basket is provided with a lifting ring which is engaged by a brush handle to raise the basket to the surface. During such upward movement, the downward force of water through the basket holds the leaves within the basket. An anti-vortex plate covers the main drain opening when the basket is removed from the main drain. The cover of the basket is released from the basket at the surface to permit removal of the leaves trapped within the basket.

5 Claims, 8 Drawing Figures

FIG. 1
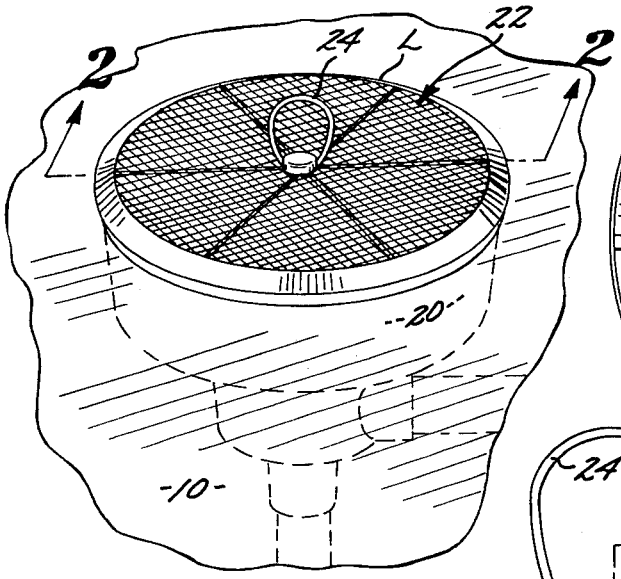
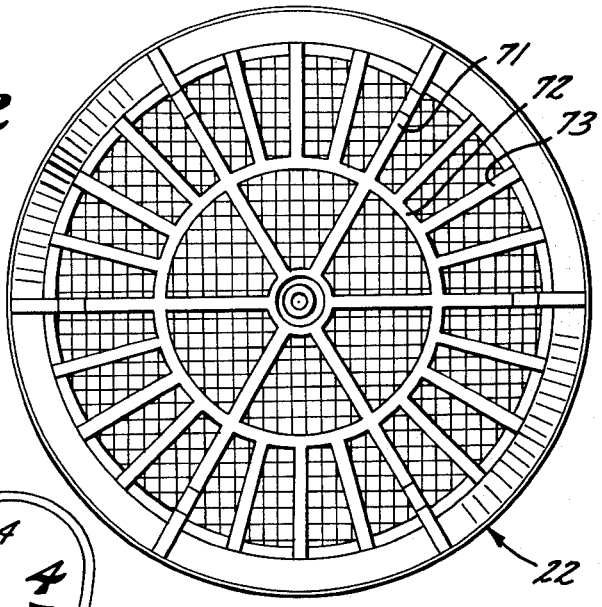
FIG. 3
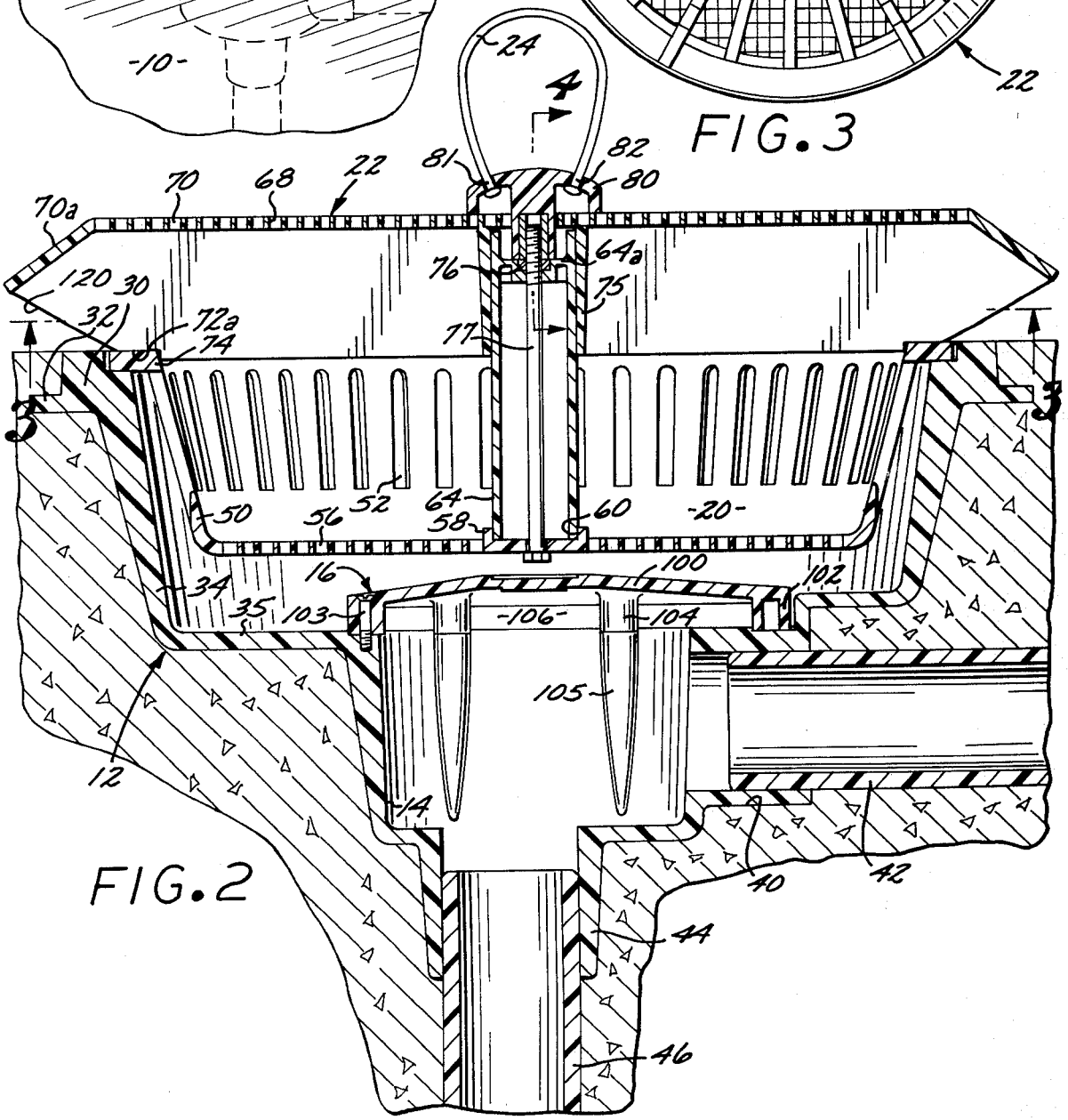
FIG. 2

FIG. 4
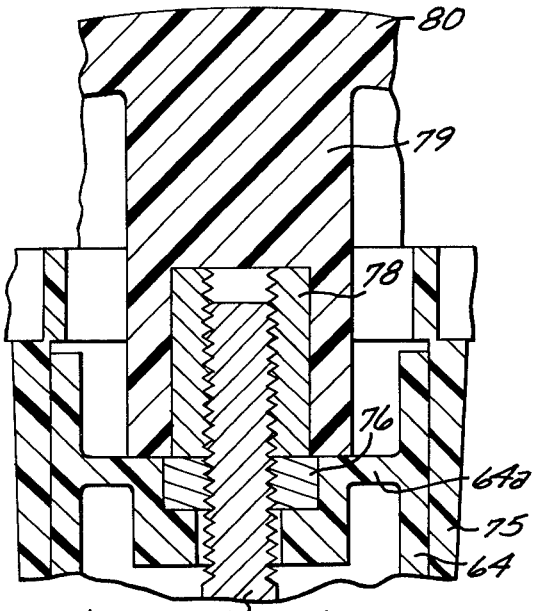
FIG. 5
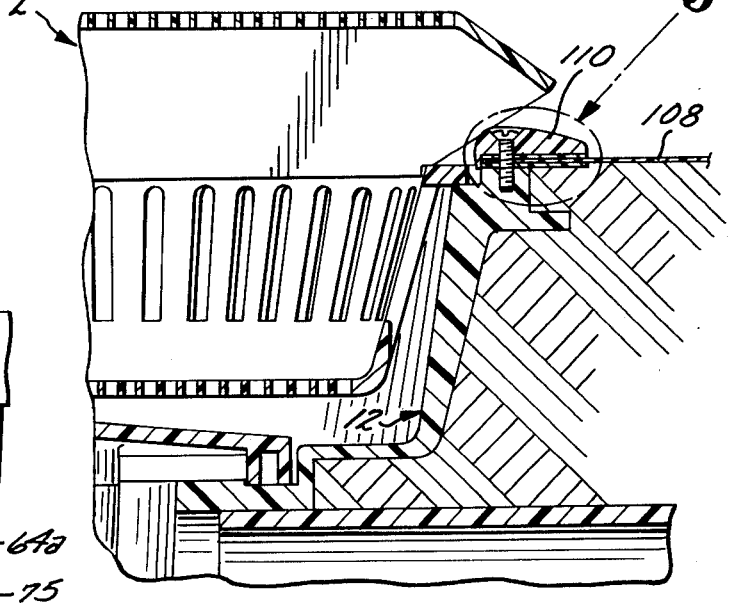
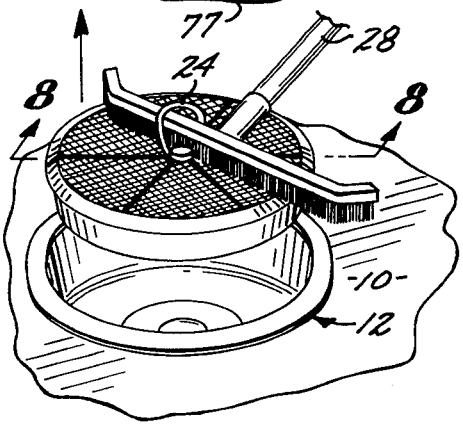
FIG. 7
FIG. 6
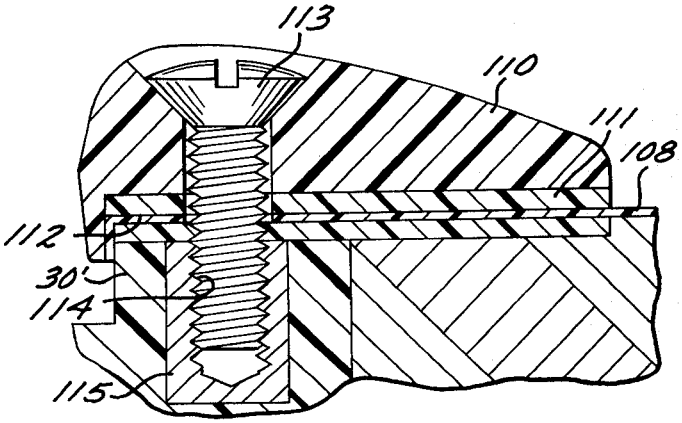
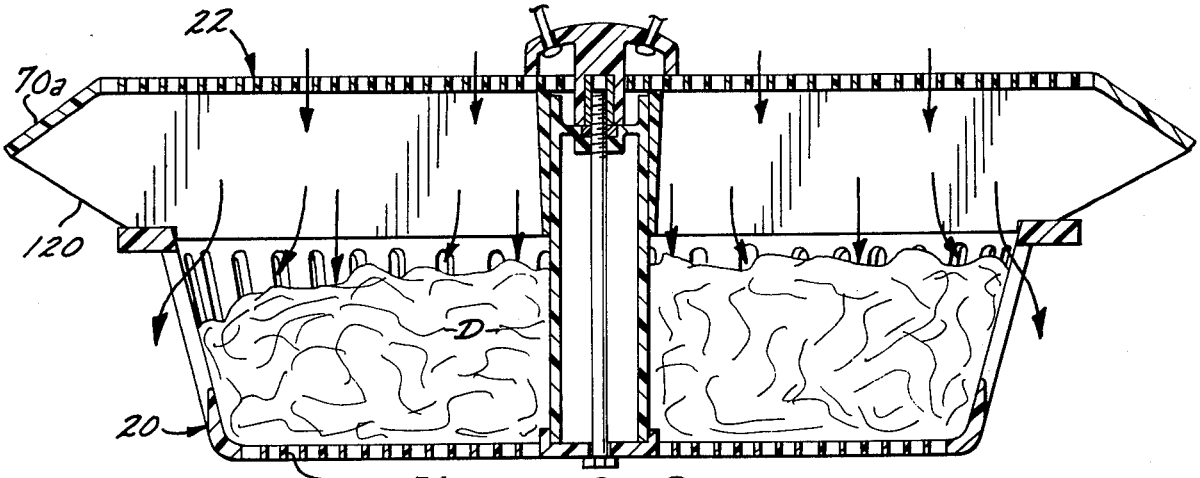
FIG. 8

LEAF TRAP AND MAIN DRAIN ASSEMBLY

BACKGROUND OF THE INVENTION

1. Field of the Invention

This invention relates generally to swimming pools and more particularly to a leaf trap and main drain assembly for the removal of leaves and other debris from the floor of a swimming pool.

2. Description of the Prior Art

Automatic swimming pool cleaners of the type disclosed in U.S. Pat. No. 3,032,044, issued May 1, 1962, are increasingly used to effect cleaning of leaves and other debris from the floor of swimming pools. Such automatic swimming pool cleaners incorporate hoses which travel in a random manner over the floor and side walls of the pool. Random movement and cleaning are effected by means of water discharge nozzles operatively associated with the hoses. For the proper operation of these automatic swimming pool cleaners it is important that no foreign obstructions be disposed in the pool tending to catch the hoses and thereby impeding the random movement of such hoses. Prior leaf trap devices have generally been of a size and construction which impede the random movement of the hoses of automatic swimming pool cleaners. Certain heretofore proposed leaf traps have suffered from the disadvantage that when being lifted from the pool for emptying, much of the trapped debris is lost back into the pool. Other types of leaf receivers, such as that shown in U.S. Pat. No. 3,321,080, utilize a bowllike basket which is positioned over the swimming pool drain. Where automatic swimming pool cleaners are utilized, however, the moving hoses tend to blow leaves and debris out of such basket.

A major problem experienced with certain prior leaf trap devices is that fine dirt collects under the trap and causes staining.

Heretofore proposed leaf trap devices require that leaves, dirt, and other debris be swept upward and over a ramp, which is part of the leaf trap, prior to being trapped in the basket. Movement of the material being swept is made difficult because of the obstructed upward path defined by such ramp.

SUMMARY OF THE INVENTION

It is a major object of the present invention to overcome the above set forth disadvantages of prior art swimming pool leaf trap arrangements.

The leaf trap and main drain assembly of the present invention includes a concave main drain which is recessed in a swimming pool floor with its upper end substantially flush with such floor. The lower end of the main drain is formed with a drain opening. An open-topped basket, having apertured bottom and side walls removably rests upon the main drain and is provided with an apertured cover removably connected to the basket. The space between the bottom of the cover and the top of the basket defines a leaf-admitting entrance to the basket. When leaves or other debris are forced into the basket, they are retained therein by the downward flow of swimming pool water through the main drain. The cover is provided with a ring that is engaged by a swimming pool brush, or the like, to raise the basket to the surface. During such upward movement leaves trapped in the basket are held therein by the downward force of water through the basket and cover created by such upward movement. When the basket has been withdrawn from the pool, the cover may be removed from the basket to permit removal of leaves trapped therein. It is important to note that an anti-vortex plate covers the main drain opening to prevent inadvertent contact of a swimmer or other object with the drain opening when the basket is not disposed within the main drain.

The cover of the basket extends only a short distance above the swimming pool floor so as to not interfere with movement of the hoses of an automatic swimming pool cleaner. The cover also serves to prevent the entrance of such hoses to the basket to insure that the hoses won't blow leaves and other debris trapped therein out of the basket. The basket is flush with the surface of the swimming pool floor so as to present an unobstructed path for leaves and other debris entering the basket.

The leaf trap and main drain assembly described herein is applicable to a wide variety of swimming pools, including gunite (concrete) pools, vinyl liner pools, and fiber glass constructed pools.

BRIEF DESCRIPTION OF THE DRAWINGS

FIG. 1 is a perspective view of a preferred form of swimming pool leaf trap and main drain assembly embodying the present invention;

FIG. 2 is a vertical sectional view taken in enlarged scale along line 2—2 of FIG. 1;

FIG. 3 is a horizontal sectional view taken along line 3—3 of FIG. 2;

FIG. 4 is a vertical sectional view taken in enlarged scale along line 4—4 of FIG. 2;

FIG. 5 is a fragmentary vertical sectional view showing a second form of leaf trap and main drain assembly embodying the present invention;

FIG. 6 is an enlarged view of the encircled area designated 6 in FIG. 5;

FIG. 7 is a perspective view showing the basket of the leaf trap being lifted from the main drain; and FIG. 8 is a vertical sectional view showing how leaves are retained in the basket when it is being lifted from the main drain.

DESCRIPTION OF PREFERRED EMBODIMENTS

Referring to the drawings, a preferred form of swimming pool leaf trap and main drain assembly L embodying the present invention is installed in the floor 10 of a swimming pool, preferably at the deepest end of such pool. The assembly L includes an annular concave main drain generally designated 12 recessed in the swimming pool floor 10 with its upper end substantially flush with the surface of the floor. The lower end of the main drain 12 is formed with a drain opening 14 covered by an anti-vortex plate generally designated 16. Main drain 12 removably houses a basket, generally designated 20, which normally rests within the confines of main drain 12. Basket 20 is provided with an apertured cover generally designated 22 which is removably secured to such basket. Cover 22 is provided with a lifting ring 24 which, as indicated in FIG. 7, may be engaged with a swimming pool brush 28, or the like whereby the cover and its attached leaf-containing basket can be lifted out of the main drain 12 to the surface for the removal of leaves from the basket.

More particularly, and with particular reference to FIGS. 1, 2, and 3, the main drain 12 is shown imbedded in the concrete swimming pool floor 10. The upper portion of main drain 12 is formed with an enlarged rim 30, the upper surface of which is flush with the upper surface of swimming pool floor 10. The lower portion of rim 30 includes a lip 32 which is rigidly embedded within the concrete of swimming pool floor 10. The side walls 34 of main drain 12 taper downwardly and radially inwardly to their juncture with a bottom wall 35. One side of main drain 12 is formed with an elbow 40 that receives the upstream end of swimming pool return line 42. The bottom of main drain 12 is formed with a tubular fitting 44 that receives the upper end of a static relief valve line 46. Main drain 12 is preferably of integral construction formed of a suitable synthetic plastic. It may, however, be of metallic construction.

Basket 20 is of open-topped concave construction, having its upper end normally flush with the upper surface of main drain 12. Its side walls 50 are formed with a plurality of slotted apertures 52. The major portion of its bottom wall 54 is formed with a plurality of apertures 56. The center portion of bottom wall 54 is of solid construction defining a coaxially apertured disc 58 provided with an upwardly opening annular recess 60. Recess 60 receives the lower end of an upstanding center post 64, with the lower end of such post being bonded to the aforementioned disc 58. Basket 20 may be formed of ABS plastic material with about 20% fiber glass reinforcement.

Cover 22 includes a flat plate 68 formed over substantially its entire surface with a plurality of small apertures 70. The radially outer portion of plate 68 extends downwardly and radially outwardly to define a baffle shield 70*a*. As indicated in FIG. 3, the underside of plate 68 is integrally formed with a plurality of spoke-like main ribs 71. Flat plate 68 also includes a circular reinforcing ring 72 connected to a plurality of shorter reinforcing ribs 73. The radially outer lower portion of the main ribs 71 are formed with cut-outs 72*a* that rest upon the lip 74 of basket 20 in a concentric manner whereby cover 22 is coaxially supported upon the basket 20. Cover 22 may be formed of polypropylene with about a 30% fiber glass reinforcement, ABS or other suitable plastic material.

A vertical tube 75 integrally depends from the center portion of plate 68 coaxial with such plate and is preferably molded as part of cover 22. Tube 75 is telescopically received by the upper portion of post 64 to center the cover on the basket. Post 64 may be of PVC or other suitable plastic material.

Referring particularly to FIGS. 2 and 4, the upper portion of post 64 includes an integral web 64*a* formed with a coaxial bore housing a nut 76. An elongated bolt 77 extends upwardly from below disc 58 with its threaded upper end extending through wall 75 and nut 76 into a threaded socket 78 fixedly coaxially carried by the neck portion 79 of a synthetic plastic locking knob 80. Nut 76 retains bolt 77 with its headed end abutting the underside of disc 58. Knob 80 is formed with a pair of holes 81 and 82 through which extend the opposite ends of lifting ring 24. Lifting ring 24 will preferably be formed of a plastic tube that houses a cord, the ends of such cord being extended through holes 81 and 82 to retain the lifting ring 24 on locking knob 80. Polypropylene may be utilized to fabricate the tube and cord.

It should be understood that cover 22 is normally secured upon basket 20 by threading the upper end of bolt 77 into socket 78, knob 80 resting upon the upper surface of the cover. It should also be understood that lifting ring 24 floats whereby it will assume a generally vertically extending position when submerged.

The anti-vortex plate 16 includes a solid lid 100, the outer portion of which is integrally formed with one or more depending pads 102 which rest upon the bottom wall 35 of main drain 12 and are secured thereto by one or more bolts 103 which extend downwardly through such pads into the main drain. A plurality of posts 104 also depend from lid 100, with their lower ends of each of such posts resting upon the upper surfaces of complementary pads 105 integrally formed on the side walls of sump 38. The space 106 between the bottom wall 35 and plate 100 permits the downward flow of swimming pool water through main drain opening 14.

Installation of the leaf trap assembly of the present invention is different for a gunite (i.e. concrete) pool than for a vinyl liner pool. A distinction should be made between the two installations. FIG. 1 shows the configuration for a gunite pool. FIGS. 5 and 6 show the configuration for a vinyl liner pool. The major difference is that a clamping ring and two gaskets are required for a vinyl liner pool to securely attach the vinyl to the drain, one gasket is between the drain and vinyl and the other is between the vinyl and clamp. Immediately surrounding and supporting the drain unit is concrete, and then sand is used under the rest of the vinyl pool.

Referring now to FIGS. 5 and 6, the aforedescribed swimming pool leaf trap and main drain assembly L is shown mounted within a vinyl liner type swimming pool. The vinyl liner membrane 108 is seen to extend over the upper edge of main drain 12 and is secured thereupon by a ring 110, with one gasket 111 being interposed between the underside of ring 110 and the membrane, and another gasket 112 between the membrane 108 and the main drain upper rim 30. The ring 110 is secured in place by a plurality of bolts 113 which extend downwardly through ring 110 and into threaded bores 114 formed in insert 115 molded into rim 30 of the main drain. It should be understood that the construction of the leaf trap assembly L shown in FIGS. 5 and 6 is the same as that shown in FIGS. 1–4, with the exception of the inserts 115 molded into main drain rim 30'.

In the operation of the aforedescribed leaf trap and main drain assembly, the anti-vortex plate 16 will be installed as shown in FIG. 2. Thereafter the basket 20 with its attached cover 22 will be lowered into the main drain 12, as also indicated particularly in FIG. 2. During normal operation of the swimming pool, water from the pool will move downwardly through the confines of the basket 20, the main drain 12 and out of the return line 42. When leaves or other debris enter basket 20 through the annular space 120 between the underside of cover baffle shield 71 and the upper surface of the swimming pool floor 10, such materials will be retained within the confines of basket 20 and cover 22 by virtue of the pressure created by the downwardly moving water. It should be understood that the apertures formed in the basket and its cover are sufficiently small to preclude the escape of leaves or other debris from the basket, but are of sufficient area to permit free downward flow of swimming pool water. It should also be understood that the size of annular space 120 is sufficiently small enough to prevent catching the hoses of a swimming pool cleaner. With the basket and its cover in place, the lifting ring 24 assumes its upwardly extending position shown in FIGS. 1, 2, and 7 by virtue of its buoyancy. When it is desired to remove the basket 20, a conventional swimming pool cleaning brush 28 may be utilized to hook the lifting ring 24, as indicated in FIG. 7, so as to permit the basket to be raised upwardly out of main drain 12.

Referring now to FIG. 8, it should be particularly observed that during upward movement of the basket 20 the downward flow of water created by such upward movement will positively retain the leaves and other debris D within the confines of basket 20. In FIG. 8 the downward flow of water is indicated by the directional arrows. When the basket has been lifted out of the swimming pool and deposited on the deck thereof, the plastic locking knob 80 is rotated so as to become unscrewed from bolt 77. Thereafter, cover 22 may be lifted free of basket 20 and the contents of the basket dumped therefrom. The cover 22 and the lifting loop 24 are then replaced and locked in place on the basket. Lifting loop 24 and the swimming pool brush are then utilized to again position the basket within the main drain 20. During the time the basket 20 is withdrawn from the main drain 12, the solid lid 100 of anti-vortex plate 16 serves to prevent inadvertent contact of a swimmer's foot or other object with the main drain 12. Hence, protection is afforded against a swimmer, particularly a child, or a pet from the effect of downward suction into the drain system of the pool.

Various modifications and changes may be made with respect to the foregoing detailed description without departing from the spirit of the present invention.

I claim:

1. A swimming pool leaf trap and main drain assembly, comprising:

a concave main drain recessed in a swimming pool floor with its upper end substantially flush with the floor of said swimming pool, the lower end of said main drain being formed with a drain opening in communication with a return line;

a horizontal anti-vortex plate vertically aligned with and attached to said main drain and covering said drain opening and spaced thereabove to define a space that permits downward water flow therethrough but preventing inadvertent human or animal contact with said return line;

an open-topped basket vertically aligned with and above said main drain and having an apertured bottom and a plurality of apertures formed along its side walls, the upper periphery of said basket removably resting upon the outer edge of the upper end of said main drain, with the upper surface of said basket and the upper surface of main drain being substantially contiguous and flush with the upper surface of the swimming pool floor;

an apertured cover for said basket, the apertures in said basket and cover being sufficiently small to preclude the escape of leaves from the basket but of sufficient area to permit free downward flow of pool water through said basket and cover, and with the periphery of said cover extending downwardly to define a baffle shield;

rib means depending from said cover to said basket to coaxially support said cover spaced above said basket, with the circumferential space between the peripheries of said basket defining a leaf-admitting entrance to said basket and with the normal downward flow of swimming pool water through said main drain retaining leaves admitted into said basket trapped within said basket;

connection means releasably interconnecting said basket and said cover; and a lifting ring secured to said cover whereby said basket and cover may be raised to the surface with leaves trapped in said basket being held therein by the downward force of water through said basket and cover created during upward movement of said basket and cover, and with said cover being released from said basket at the surface of the pool to effect removal of the leaves trapped therein.

2. A swimming pool leaf trap and main drain assembly as set forth in claim 1 wherein:

said basket and cover are formed with vertical telescopically interfitting post and tube means to center the cover on the basket, with one of said means supporting said connection means.

3. A swimming pool leaf trap and main drain assembly as set forth in claim 1 wherein:

said lifting ring is buoyant.

4. A swimming pool leaf trap and main drain assembly as set forth in claim 3 wherein:

said basket and cover are formed with vertical telescopically interfitting post and tube means to center the cover on the basket, with one of said means supporting said connection means.

5. A swimming pool leaf trap and main drain assembly as set forth in claim 4 wherein:

said connection means includes a threaded element carried by said post that extends upwardly through said cover to engage a complementary threaded socket carried by a locking knob to which is attached said lifting ring.

* * * * *